US006036554A

United States Patent [19]

Koeda et al.

[11] Patent Number: 6,036,554

[45] Date of Patent: Mar. 14, 2000

[54] JOINT DEVICE FOR AN AUTOMOTIVE WIRING HARNESS

[75] Inventors: Kazumasa Koeda; Hiroyuki Yoshino; Hiroaki Hattori, all of Yokkaichi, Japan

[73] Assignee: Sumitomo Wiring Systems, Ltd., Japan

[21] Appl. No.: 09/124,880

[22] Filed: Jul. 30, 1998

[30] Foreign Application Priority Data

Jul. 30, 1997 [JP] Japan ..... 9-204353

[51] Int. Cl.[7] ..... H01R 11/09

[52] U.S. Cl. ..... 439/797; 439/796

[58] Field of Search ..... 439/709, 792, 439/796, 798, 797

[56] References Cited

U.S. PATENT DOCUMENTS

| | | | |
|---|---|---|---|
| 4,206,959 | 6/1980 | DeVries | 339/59 |
| 4,345,806 | 8/1982 | McHenney | 339/19 |
| 4,432,594 | 2/1984 | Daggett | 339/258 |
| 5,064,384 | 11/1991 | Weaver | 439/511 |
| 5,145,413 | 9/1992 | Okamoto et al. | 439/620 |
| 5,733,153 | 3/1998 | Takahashi et al. | 439/801 |

FOREIGN PATENT DOCUMENTS

| | | |
|---|---|---|
| 0 075 455 | of 1983 | European Pat. Off. . |
| 40 16 521 | of 1991 | Germany . |
| 63-117061 | of 1988 | Japan . |
| 8-222297 | of 1996 | Japan . |
| 9-55237 | of 1997 | Japan . |
| 63-95180 | of 1998 | Japan . |

OTHER PUBLICATIONS

Derwent Publications Ltd., London, GB; AN 96–04755—XP002082588—Okumura Hitoshi—"Earthing junction terminal fitting for motor vehicle wiring harness" & JP 07 312248 A (Sumitomo Denso KK), Nov. 28, 1995.

*Primary Examiner*—Khiem Nguyen
*Assistant Examiner*—V. Johnson
*Attorney, Agent, or Firm*—Anthony J. Casella; Gerald E. Hespos

[57] ABSTRACT

A joint circuit is provided to form a joint circuit without inserting terminals into a connector at a later stage. The joint circuit employs terminals 35 that have mount holes. The terminals 35 are connected in advance with ends of wires to be connected with each other among the wires which will form an automotive wiring harness. Partition walls 21 are provided in an insulation casing 20 to define a plurality of terminal connecting chambers 22, 23. The heads of bolts are embedded in the bottom walls of the respective terminal connecting chambers so that the shafts thereof project. The mount holes of the terminals at the ends of the wires to be connected with each other are fitted down on the bolt shafts and are tightened by nuts to form a joint circuit. This joint circuit includes a joint circuit for grounding.

6 Claims, 5 Drawing Sheets

JOINT DEVICE FOR AN AUTOMOTIVE WIRING HARNESS

BACKGROUND OF THE INVENTION

1. Field of the Invention

The present invention relates to a joint device for an automotive wiring harness and is particularly designed to form a joint circuit by connecting wire groups which will form a wiring harness with each other without using a splice connection and a connection by a joint connector so as to make it unnecessary to later insert terminals into a connector when a wiring harness is formed on an assembly board.

2. Description of the Prior Art

Conventionally, wire groups of a prior art wiring harness have been connected with each other to form a joint circuit by a splice connection as shown in FIG. 8 or by using a joint connector 1 as shown in FIG. 9.

The prior art splice connection shown in FIG. 8, is formed by exposing cores at the ends of wires w2, w3. The exposed cores then are connected with a wire w1 that has been peeled in intermediate positions by intermediate barrels 2 when a partly bound harness is formed. Terminals at the ends of the wires w2, w3 of the partly bound harness having these prior art splice connection portions are inserted into a connector 3 of another partly bound harness for connection, and the wiring harness then is fully bound on an assembly board.

A connection is made with the prior art joint connector 1 shown in FIG. 9 by inserting terminals 4 connected with wire ends into a joint connector 1. The terminals 4 then are connected by a joint busbar 5 that has been accommodated in the joint connector 1. All wires cannot be connected with the joint connector 1 when the partly bound harness is formed. Accordingly, the wires of one partly bound harness are connected with the joint connector 1 at this stage, and terminals at ends of wires of an other partly bound harness are inserted later into the joint connector 1 for connection when the wiring harness is fully bound on the assembly board.

As described above, in each of the prior art connection by splices shown in FIG. 8 and the prior art connection by the joint connector shown in FIG. 9, there are terminals which are not inserted into the connector, i.e. the terminals are not completely inserted into the connector when the partly bound harness is formed. Thus, these terminals need to be inserted later into the connector of the other partly bound harness when the wiring harness is fully bound on the assembly board. Terminals that are to be inserted later into the connector, must be inserted carefully into specified terminal cavities. This results in more labor and time for the connection, a reduced productivity and a higher likeliness of an error insertion.

In view of the above problem, an object of the present invention is to form a joint circuit simply and easily by eliminating the later insertion of terminals into a connector.

SUMMARY OF THE INVENTION

According to the invention, there is provided a joint device for an automotive wiring harness. The joint device has an insulation casing with a plurality of terminal connecting chambers defined therein. The terminal connecting chambers may be defined by at least one partition wall in the casing. A bolt is mounted in each terminal connecting chamber such that the shaft of the bolt projects into the corresponding terminal connecting chamber. Preferably, the bolts have heads substantially embedded in the walls of the respective terminal connecting chambers. Terminals with mount holes are connected with ends of wires to form an automotive wiring harness. The mount holes are fitted or fittable down on the shafts of the bolts, and then are tightened by nuts to form a joint circuit.

As described above, a joint circuit is formed in a manner differently from the prior art splice connection or connection by a joint connector. Specifically, terminals formed with mount holes (hereinafter, "LA terminals") are connected in advance with the ends of the wires and are connected with each other using bolts and nuts. By mounting the LA terminals one after another on the shafts of the bolts and tightening them by the nuts, the wires can be connected easily and surely as compared with a case where the terminals are inserted into a connector at a later stage.

Preferably, the joint device further comprises an earth plate of metal projecting from an outer surface of the insulation casing and formed with a bolt hole into which a bolt projecting from a vehicle body is insertable. The earth plate preferably is secured to the bolt projecting from the vehicle body by a nut to achieve grounding.

The terminals connected with the ends of the wires of the wiring harness which form an earth circuit may be mounted or mountable on the bolt projecting from the vehicle body by fitting the mount holes thereof down on the bolt and may be fastened with a nut. Thus the wires of the wiring harness are connected with the vehicle body to establish an earth, while simultaneously securing the insulation casing to the vehicle body. With this construction, the insulation casing can be used for the circuit connection of the wires and at the same time, can be used to ground a plurality of wires. Further, the insulation casing can be secured to the vehicle body while the wires are grounded.

Alternatively or additionally, the joint device may further comprise an earth plate of metal projecting from an outer surface of the insulation casing and partly projecting into one terminal connecting chamber provided in the insulation casing. The portions of the earth plate projecting into the terminal connecting chamber and projecting from the outer surface of the insulation casing both are formed with a mount hole. The shaft of the bolt projecting from the bottom wall extends or can extend through the mount hole of the earth plate in the one terminal connecting chamber. The mount hole of the terminals connected with the ends of the wires forming an earth circuit are fitted or fittable down on the shaft of the bolt and are tightened or tightenable by the nut to be connected with the earth plate. The mount hole of the portion of the earth plate projecting from the outer surface of the insulation casing is fitted or fittable down on the bolt projecting from the vehicle body and is tightened or tightenable by the nut, thereby simultaneously connecting the wiring harness with the vehicle body to establish an earth and securing the insulation casing with the vehicle body.

With this construction, the wires to be grounded are fixedly connected with the bolt that had been connected with the earth plate inside the insulation casing beforehand. Accordingly, the grounding and the securing of the insulation casing to the vehicle body can be performed only by fitting the mount hole of the earth plate projecting from the insulation casing to the shaft of the bolt projecting from the vehicle body and screwing the nut down on the shaft when the wiring harness is mounted in the vehicle body. Thus, it is not necessary at all to connect the terminals of the bolt shaft when the wiring harness is mounted on the vehicle body, and the assembling of the wiring harness on the vehicle body is easier.

Preferably, wire guiding ribs are provided on the inner surfaces of one or more bottom walls of the respective terminal connecting chambers of the insulation casing about the shafts of the bolts projecting from the bottom walls. Thus wire connecting portions of the terminals to be placed one over another on the shafts of the bolts are passed one by one through clearances between the wire guiding ribs so as to be rotationally displaced with respect to each other or to avoid mutual interference. Such a displacement of the terminal connecting portions of the plurality of wires to be mounted on one bolt shaft can prevent the thick terminal connection portions from being placed one over another.

The insulation casing preferably is provided integrally or separately with a cover for substantially closing an opening after the terminals are connected. In the case that the cover is integrally formed, it is connected via a thin hinge. Further, the cover is preferably lockable regardless of whether it is integrally or separately provided.

These and other objects, features and advantages of the present invention will become more apparent upon a reading of the following detailed description and accompanying drawings.

DETAILED DESCRIPTION OF THE PREFERRED EMBODIMENTS

Figure 1:
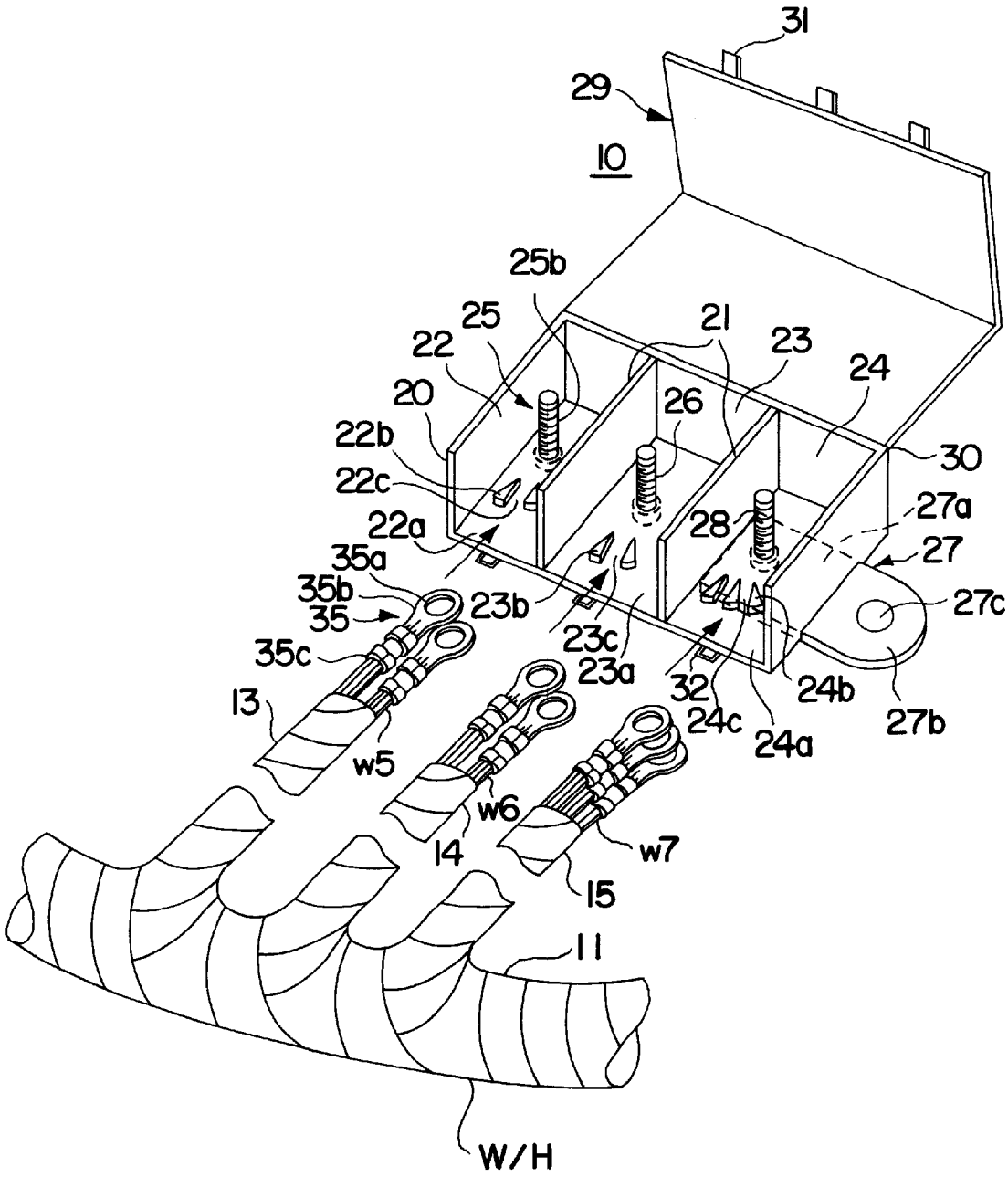
FIG. 1 is an exploded perspective view of a first embodiment.
Figure 2:
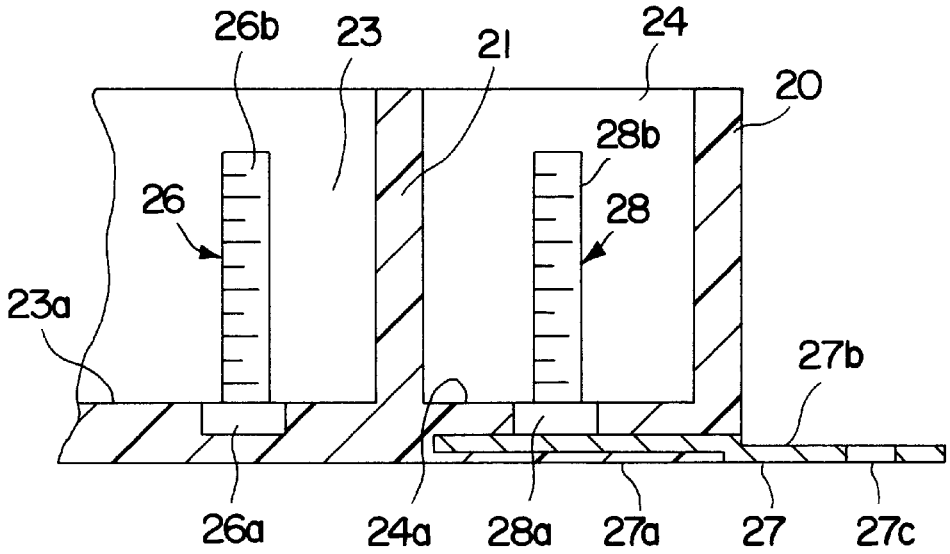
FIG. 2 is a section of an essential portion of FIG. 1.
Figure 3:
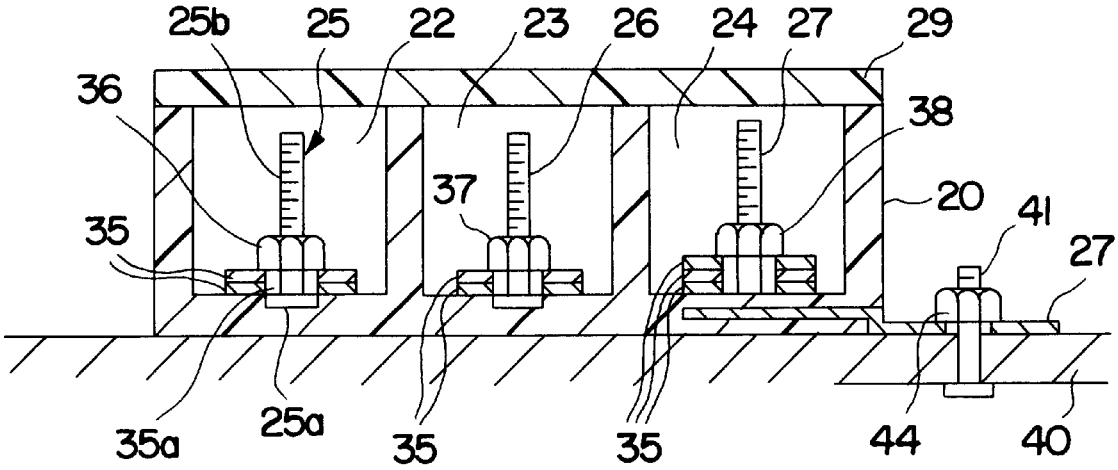
FIG. 3 is a schematic diagram showing the connection of wires and a joint device.

A joint device according to a first embodiment of the invention is identified generally by the numeral 10 in FIGS. 1 to 3. The joint device 10 defines part of a first connecting circuit formed by joining a plurality of wires of a first branch portion 13 that have been branched from a main portion 11 of a wiring harness W/H, a second connecting circuit formed by joining a plurality of wires of a second branch portion 14, and a third circuit formed by a plurality of wires of a third branch portion 15 that preferably are grounded to a vehicle body.

The joint device 10 is comprised of a substantially box-shaped insulation casing 20 having an open upper surface and an open side surface. Three terminal connecting chambers 22, 23, 24 are defined by partition walls 21 in the insulation casing 20. In the two terminal connecting chambers 22, 23, heads 25*a*, 26*a* of bolts 25, 26 are substantially embedded in bottom walls 22*a*, 23*a*, and shafts 25*b*, 26*b* the bolts 25 and 26 extend into the terminal connecting chambers 22, 23, 24, preferably substantially in an upward direction from the bottom walls 22*a*, 23*a*.

An earth plate 27 extends into the remaining terminal connecting chamber 24. More particularly, the earth plate 27 has a side portion 27*a* that is inserted through a through hole formed in an outer wall 20*a* and that is substantially embedded in a bottom wall 24*a*. Further, a head 28*a* of a bolt 28 is substantially embedded in the bottom wall 24*a* while being held in contact with the earth plate 27. The bolt 28 has a shaft 28*b* which projects upwardly through the side portion 27*b* of the earth plate 27.

The earth plate 27 further has a portion 27*b* which projects outwardly from the outer wall 20*a*. This projecting portion 27*b* extends in the substantially same plane as the bottom wall of the insulation casing 20, and is formed with a bolt hole 27*c*.

As described above, the shafts 25*b*, 26*b*, 28*b* project from the centers of the bottom walls 22*a*, 23*a*, 24*a* of the respective terminal connecting chambers 22, 23, 24. A plurality of ribs 22*b* project from the bottom wall at specified intervals in such a manner as to substantially surround the shaft 25*b*, thereby defining a plurality of wire guiding portions 22c between the ribs 22*b*. Likewise, ribs 23*b*, 24*b* project about the bolts 26*b*, 28*b*, respectively to define a plurality of wire guiding portions 23*c*, 24*c*.

The insulation casing 20 is formed integrally or unitarily with a cover member 29 preferably having an L-shaped cross section and connected to remaining parts of the casing 20 via a thin hinge 30. The cover member 29 is adapted to substantially close the open upper and side surfaces. The cover member 29 is formed with openings 29*a* for permitting the wires to be withdrawn from the respective terminal connecting chambers. Additionally, locking portions 31 and engaging portions 32 are provided for holding the cover member 29 and the insulation casing 20 in a locked condition.

Terminals 35 are secured to ends of a plurality of wires w5 of the first branch portion 13, to ends of a plurality of wires w6 of the second branch portion 14 and to ends of a plurality of wires w7 of the third branch portion 15, all of which are connected or connectable by the joint device 10. Each terminal 35 is preferably a so-called LA terminal which is formed at its leading with a substantially circular electrical contact portion 35*b* having a mount hole 35*a*. A barrel portion 35*c* of the terminal 35 is disposed behind the contact portion 35*b* and is secured to the wire e.g. by clamping or cramping.

A circuit connection construction and an earth connection construction using the joint device 10 are described below.

The terminals 35 secured to a plurality of wires w5 of the first branch portion 13 of the wiring harness are inserted into the terminal connecting chamber 22 of the joint device 10 and the respective mount holes 35*a* are fitted down on the bolt 25*b*. These wires w5 pass respectively through the wire guiding portions 22*c*, so that the barrel portions 35*c* are not placed one over another. In other words, the barrel portions 35*c* of each wire w5 is rotationally displaced or shifted by an angle different from 0° or 360° about the axis of the shaft 25*b* at least with respect to the adjacent barrel portion(s) 35*c*. After all the mount holes 35*a* are fitted down on the bolt 25*b*, a nut 36 is screwed down to connect the wires w5 of the first branch portion 13 with each other, thereby forming a joint circuit.

Similarly, the terminals 35 secured to a plurality of wires w6 of the second branch portion 14 of the wiring harness are inserted into the terminal connecting chamber 23 of the joint device 10 and the respective mount holes 35*a* are fitted down on the bolt 26*b*. These wires w6 pass respectively through the corresponding wire guiding portions 23*c*, so that the barrel portions 35*c* are not placed one over another. The mount holes subsequently are fitted down on the bolt 26*b*, and a nut 37 is screwed down to connect the wires w6 of the second branch portion 14 with each other, thereby forming a joint circuit.

The terminals 35 secured to a plurality of wires w7 of the third branch portion 15 of the wiring harness are inserted into the terminal connecting chamber 24 of the joint device 10 and the respective mount holes 35*a* are fitted down on the bolt 28*b*. These wires w7 pass respectively through the corresponding wire guiding portion 24*c*, so that the barrel portions 35*c* are not placed one over another but are displaced rotationally with respect to each other. The mount holes subsequently are fitted down on the bolt 28*b*, and a nut 38 is screwed down to connect the wires w7 of the third branch portion 15 with each other. Since the bolt 28 is in contact with the earth plate 27, the wires w7 are already brought into contact with the earth plate 27. After the terminals 35 are inserted into the respective terminal connecting chambers and fastened by the bolts and nuts as described above, the cover member 29 is closed and locked with the insulation casing 20.

All the terminals 35 connected with the ends of the wires are fixed by the bolts and nuts when the wiring harness is assembled.

When the wiring harness is to be installed in a vehicle body, the wires w7 of the third branch portion 15 preferably are grounded to a vehicle body 40 and, at the same time, the joint device 10 is secured to the vehicle body 40 by fitting the bolt hole 27*c* of the projecting portion 27*b* of the earth plate 27 projecting from the outer surface of the insulation casing 20 down on a bolt 41 projecting from the vehicle body 40 and screwing a nut 44 down on the bolt 41.

Figure 4:
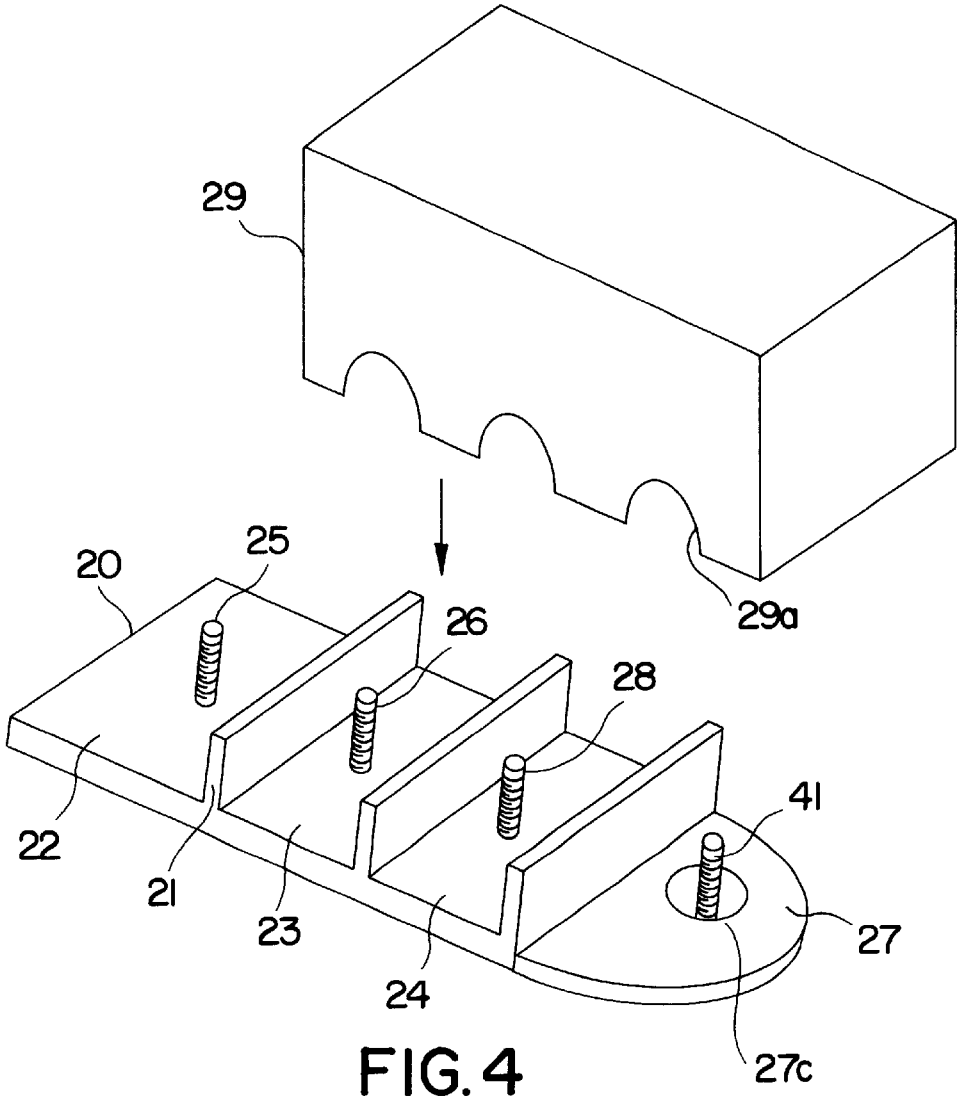
FIG. 4 is a schematic perspective view of a first modification of the first embodiment.
Figure 5:
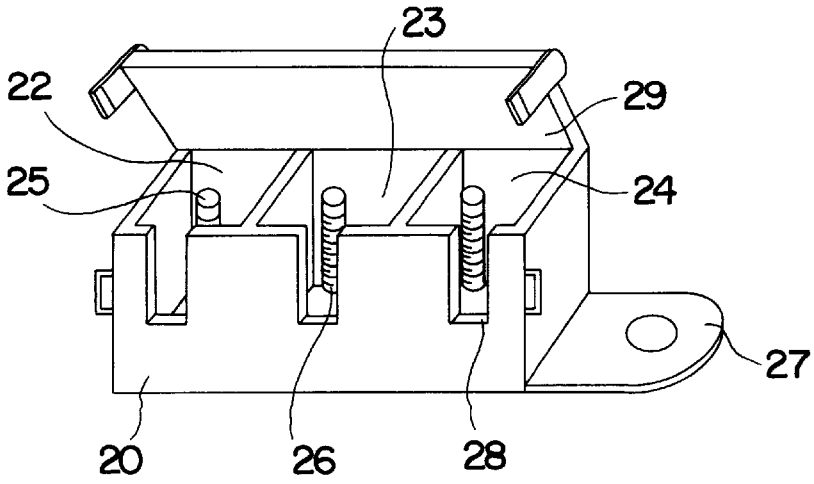
FIG. 5 is a schematic perspective view of a second modification of the first embodiment.

FIGS. 4 and 5 show modifications of the first embodiment, wherein same or similar elements are denoted with same or similar reference numerals. In a first modification shown in FIG. 4, the insulation casing 20 is comprised of a bottom wall and partition walls, and the cover member 29 is a substantially box-shaped separate member. In a second modification shown in FIG. 5, the insulation casing 20 is substantially box-shaped and has an open upper surface and the cover member 29 has a substantially planar shape. As can be seen from these, the insulation casing 20 and the cover member 29 can be suitably shaped provided that the connection of the terminals and the tightening of the bolts and nuts are easy.

Figure 6:
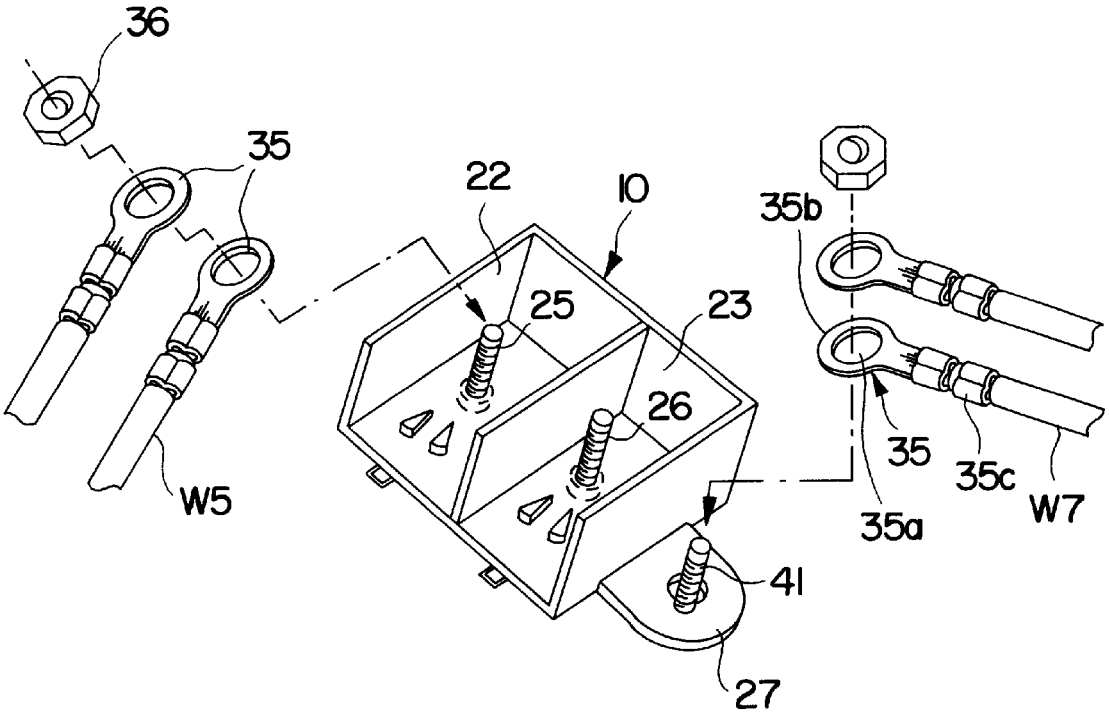
FIG. 6 is a schematic perspective view of a second embodiment.

FIG. 6 shows a second embodiment, which differs from the first embodiment in that the terminals 35 connected with the wires w7 of the third branch portion 15 are grounded by being directly fitted down on the bolt 41 projecting from the vehicle body 40. Thus, the terminal connecting chamber 24 connected with the earth plate 27 and the bolt 28 can be eliminated. No further description is given since the other construction and action are same.

Figure 7:
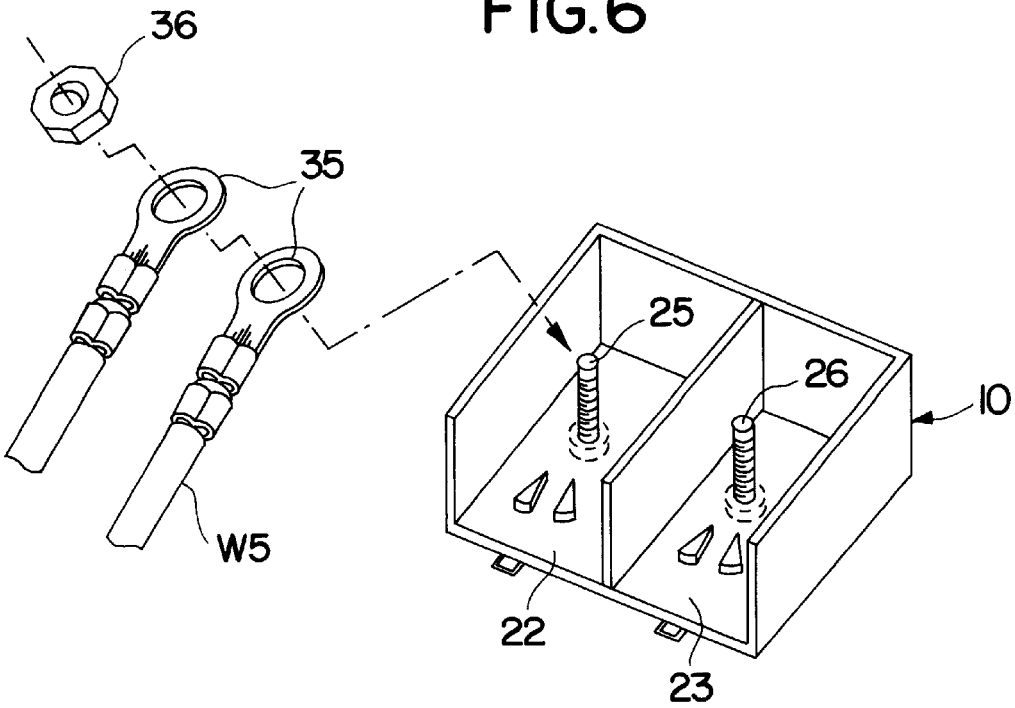
FIG. 7 is a schematic perspective view of a third embodiment.
Figure 8:
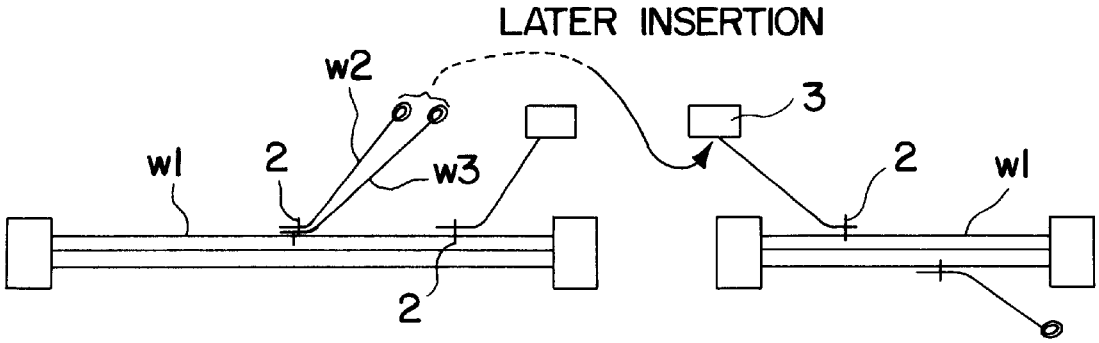
FIG. 8 PRIOR ART
FIG. 8 is a schematic view of a prior art.
Figure 9:
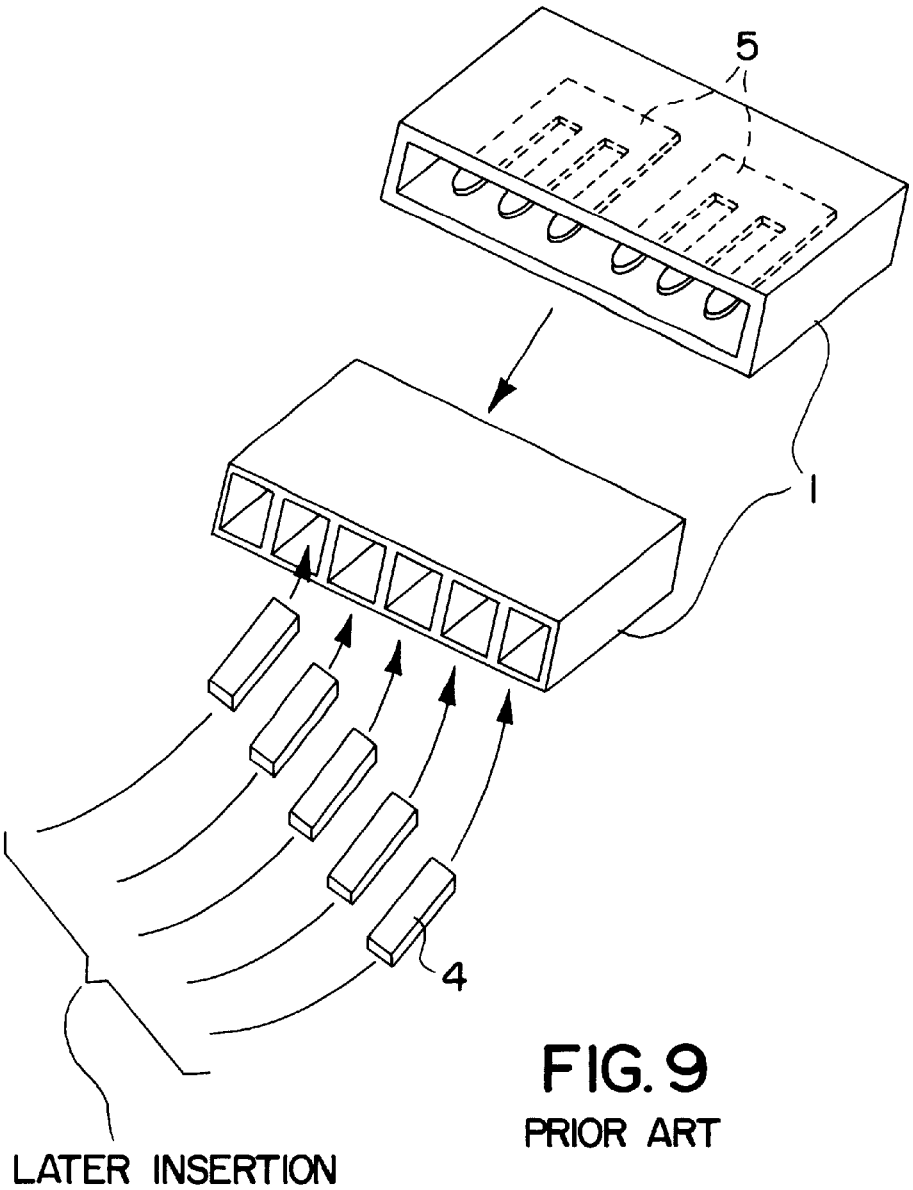
FIG. 9 PRIOR ART
FIG. 9 is a schematic view of another prior art.

FIG. 7 shows a third embodiment, which differs from the first embodiment in that only joint circuits are formed without grounding. In other words, only the terminal connecting chambers 22, 23 of the first embodiment are provided and the terminal connecting chamber 24 and the earth plate 27 are not provided.

If the construction of the third embodiment is adopted, grounding cannot simultaneously be performed. However, such a construction can be used instead of the prior art joint connector and splice connection.

As is clear from the above description, it is sufficient to insert the terminals at the ends of the wires into the terminal connecting chambers of the joint device and to fasten them by the bolts and nuts to form a joint circuit. Accordingly, operability can be improved. Further, an error insertion of the terminals into the connector can be avoided by eliminating the later insertion of the terminals into the connector on the wiring harness assembly board which has been a problem with the prior art.

A single joint device, as described above, simultaneously can perform the circuit connection and the grounding. Additionally, the grounding simultaneously secures the joint device to the vehicle body. Further, an operation of mounting the terminals on the bolt projecting from the vehicle body during the mounting of the wiring harness on the vehicle body can be eliminated.

Furthermore, since the joint circuit is formed by fitting the mount holes of the terminals down on the bolts and tightening them by the nuts, a desired number of wires can be connected to form a joint circuit without limiting the number of the terminals. This makes it easier to respond to a change in the circuit.

What is claimed is:

1. A joint device for an automotive wiring harness, the wiring harness including wires, terminals with mount holes being connected with ends of the respective wires, the joint device comprising:

an insulation casing having a bottom wall, a plurality of substantially parallel partition walls extending a selected distance from the bottom wall, a rear wall extending from the bottom wall the selected distance and extending between the partition walls to define a plurality of terminal connecting chambers between the respective partition walls, a cover wall movably disposed across edges of said partition walls remote from said bottom wall for substantially covering each of said terminal connector chambers and a front wall extending between said partition walls and partly between said bottom wall and said cover wall for providing access to said terminal connecting chambers along a front portion of said insulation casing;

a plurality of bolts mounted respectively in said terminal connecting chambers, each said bolt having a shaft; that projects a distance less than the selected distance into the corresponding terminal connecting chamber;

a plurality of nuts threadedly connected respectively with the shafts of the respective bolts; and an earth plate having a first end mounted to the insulation casing and electrically connected to one said bolt in the insulation casing, the earth plate further having a second end projecting from the insulation casing and formed with a bolt hole for securely mounting the joint device to an automotive vehicle body;

wherein the mount holes of the terminals connected with the ends of the wires of the automotive wiring harness are fittable on the shafts of the bolts, and are securable by the nuts to form a joint circuit.

2. A joint device according to claim 1, wherein the earth plate partly projects into one terminal connecting chamber of the insulation casing, the portions of the earth plate projecting into said one terminal connecting chamber being formed with a bolt hole; the shaft of the bolt projecting from the bottom wall of said one terminal connecting chamber extending through the bolt hole of the earth plate; the mount holes of the terminals connected with the ends of selected ones of the wires being fitted on the shaft of the bolt and tightened by the nut for connection with the earth plate; such that the connection of the mount hole of the portion of the earth plate projecting from the outer surface of the insulation casing with the bolt projecting from the vehicle body simultaneously connects the wire of the wiring harness with the vehicle body to establish an earth and secures the insulation casing with the vehicle body.

3. A joint device according to one claim 1, further comprising wire guiding ribs provided on inner surfaces of the respective terminal connecting chambers of the insulation casing spaced about the shafts of the respective bolts projecting into the chambers, wire connecting portions of the terminals being placed one over another on the shafts of the bolts and being passed respectively through clearances between the wire guiding ribs so that the wire connecting portions are rotationally displaced with respect to each other.

4. A joint device according to claim 1, wherein the bolts have heads adjacent the shafts thereof, the heads being substantially embedded in the bottom wall of the insulation casing such that the shafts extend into the respective terminal connecting chambers.

5. A joint device according to claim 1, wherein the back wall of the insulation casing is rigidly formed with the partition walls and the bottom wall, the cover wall being hinged to the back wall along a hinge line substantially parallel to the bottom wall.

6. A joint device according to claim 1, wherein the cover wall, the front wall and the back wall are substantially integral with one another and are removably mounted to a portion of the insulation casing having the bottom wall and the partition walls.

* * * * *